US007977594B1

(12) United States Patent
Miserendino et al.

(10) Patent No.: US 7,977,594 B1
(45) Date of Patent: Jul. 12, 2011

(54) TOGGLE SWITCH COVER ADAPTER

(75) Inventors: Thomas A. Miserendino, Gilbert, AZ (US); Jeffrey P. Baldwin, Phoenix, AZ (US)

(73) Assignee: TayMac Corporation, Gilbert, AZ (US)

( * ) Notice: Subject to any disclaimer, the term of this patent is extended or adjusted under 35 U.S.C. 154(b) by 346 days.

(21) Appl. No.: 12/389,111

(22) Filed: Feb. 19, 2009

Related U.S. Application Data

(60) Provisional application No. 61/029,660, filed on Feb. 19, 2008.

(51) Int. Cl.
*H01H 9/00* (2006.01)

(52) U.S. Cl. ..... 200/330; 200/331

(58) Field of Classification Search ..... 200/330, 200/331, 302.1–302.3, 553, 558, 561, 564, 200/568, 572; 174/66, 67
See application file for complete search history.

(56) References Cited

U.S. PATENT DOCUMENTS 2,213,657 A * 9/1940 Rowe ..... 200/330
2,240,922 A * 5/1941 Bissell ..... 200/302.1
2,639,356 A * 5/1953 Savage ..... 200/330
3,024,339 A * 3/1962 Johnson ..... 200/331
RE26,113 E * 11/1966 Carter et al. ..... 200/50.34
3,752,947 A * 8/1973 Strobel ..... 200/332
4,151,385 A * 4/1979 Neuser et al. ..... 200/331
4,745,243 A * 5/1988 Wang ..... 200/331
5,286,935 A * 2/1994 Mina et al. ..... 200/330
6,403,903 B1 * 6/2002 Montano et al. ..... 200/331

* cited by examiner

*Primary Examiner* — Michael A Friedhofer
(74) *Attorney, Agent, or Firm* — Booth Udall, PLC

(57) ABSTRACT

A weatherproof toggle switch cover adapter assembly comprises a cover plate adapted for placement over a toggle switch and coupling with an electrical junction box. A lever rotationally pivotably coupled with the cover plate is in mechanical communication with the toggle switch through a yoke. When the lever is moved to an on position, the toggle switch also moves to an on position. The yoke comprises two opposing tines defining a yoke spanning gap having a perimeter edge, the yoke spanning gap sized to straddle the toggle switch. An adapter ring comprising an external perimeter edge and an internal perimeter edge is interposed between the yoke and the toggle switch. The external perimeter edge is in communication with the perimeter edge of the yoke. The internal perimeter edge is inside two opposing tines and is disposed about an adapter spanning gap sized to straddle the toggle switch.

16 Claims, 3 Drawing Sheets

12
24
26
24
12
10
11

21
20
24
10

10
18

24
26
21
10
18
11

21
14
16
12
10
11

26
21
20
14
20
24
22
18

TOGGLE SWITCH COVER ADAPTER

CROSS REFERENCE TO RELATED APPLICATIONS

This Application claims the benefit of the filing date of U.S. Provisional Patent Application 61/029,660 to Miserendino entitled "Weatherproof Toggle Switch Cover Adapter," which was filed on Feb. 19, 2008, the disclosure of which is hereby incorporated herein by reference.

BACKGROUND

1. Technical Field

Aspects of the present document relate generally to toggle switch covers and more specifically to toggle switch covers having adapters to adapt for different toggle switch sizes.

2. Background Art

Toggle switch cover adapters, and more particularly weatherproof toggle switch cover adapters, are commonly used to adapt or convert linearly-positionable toggle switches to switches that are rotationally pivotable. Toggle switches are typically provided in various sizes and according to various specifications, such as 15-Ampere and 20-Ampere toggle switches.

SUMMARY

Aspects of this document relate to toggle switch cover adapters.

In one aspect, a weatherproof toggle switch cover adapter assembly comprises a cover plate adapted for placement over a toggle switch and coupling with an electrical junction box. The assembly further comprises a lever rotationally pivotably coupled with the cover plate and in mechanical communication with the toggle switch through a yoke such that when the lever is moved to an on position the toggle switch also moves to an on position. The yoke comprises two opposing tines defining a yoke spanning gap having a perimeter edge, the yoke spanning gap sized to straddle the toggle switch. In addition, the assembly includes an adapter ring comprising an external perimeter edge and an internal perimeter edge, wherein the external perimeter edge is in communication with the perimeter edge of the yoke, and wherein the internal perimeter edge is located inside two opposing tines and is disposed about an adapter spanning gap. The adapter spanning gap is sized to straddle the toggle switch.

Particular implementations may include one or more of the following. The assembly may further comprise a weatherproof gasket adjacent to an edge of the cover plate. The external perimeter edge of the adapter ring may comprise a channel sized to receive a portion of the perimeter edge of the yoke. The channel of the adapter ring may be sized to slidably receive therein the two opposing tines of the yoke such that the channel is in communication with the perimeter edge of the yoke via the sliding fit of two opposing tines within the channel. The external perimeter edge of the adapter ring may comprise one or more raised portions. The perimeter edge of the yoke may comprise a channel sized to slidably accept therein the one or more raised portions of the adapter ring such that the external perimeter edge of the adapter ring is in communication with the perimeter edge of the yoke via the sliding fit of the one or more raised portions within the channel.

In another aspect, a weatherproof toggle switch cover adapter assembly comprises a cover plate adapted for placement over a toggle switch and coupling with an electrical junction box. The assembly further includes a lever rotationally pivotably coupled with the cover plate and in mechanical communication with the toggle switch through a yoke such that when the lever is moved to an on position the toggle switch also moves to an on position, wherein the yoke comprises two opposing tines defining a yoke spanning gap having a perimeter edge, the yoke spanning gap sized to straddle the toggle switch. In addition, the assembly comprises an adapter ring interposed between the yoke and the toggle switch, the adapter ring comprising two opposing tine recesses each sized to accept therein one of the two opposing tines, each tine recess defined by a locking tab and spacer body and, wherein the two opposing tines of the yoke are secured within its corresponding tine recess via impingement of the respective locking tab its respective opposing tines, and wherein a space between the spacer bodies defines an adapter spanning gap having an internal perimeter edge, the adapter spanning gap sized to straddle the toggle switch.

Particular implementations may include one or more of the following. The perimeter edge of the yoke may be curvilinear. The internal perimeter edge of the adapter ring may be curvilinear. The assembly may further comprise a weatherproof gasket adjacent to an edge of the cover plate.

In another aspect, a method of configuring a weatherproof toggle switch cover adapter assembly comprises placing an adapter ring between two opposing tines of a yoke, coupling the adapter ring to a perimeter edge of the two opposing tines of the yoke, and straddling the toggle switch with a spanning gap of the adapter ring.

Particular implementations may include one or more of the following. Coupling the adapter ring to the yoke may comprise placing an external perimeter edge of the adapter ring adjacent to a perimeter edge of the two opposing tines of the yoke. Coupling the adapter ring to the yoke may comprise placing an external perimeter edge of the adapter ring in direct contact with the perimeter edge of the two opposing tines of the yoke. Coupling the adapter ring with the yoke may comprise pressure fitting the adapter ring between the two opposing tines of the yoke. Coupling the adapter ring with the yoke may comprise selectively mating the two opposing tines of the yoke with the channel of the adapter ring. Coupling the adapter ring with the yoke may comprise impinging the two opposing tines of the yoke in two opposing tine recesses of the adapter ring via impingement of a locking tab of the adapter ring on each of the two opposing tines.

The foregoing and other aspects, features, and advantages will be apparent to those having ordinary skill in the art from the DESCRIPTION and DRAWINGS, and from the CLAIMS.

BRIEF DESCRIPTION OF THE DRAWINGS

A gangable electrical unit will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended operation of a weatherproof toggle switch cover adapter assembly and/or assembly procedures for a weatherproof toggle switch cover adapter assembly will become apparent from this disclosure. Accordingly, for example, although particular assemblies, cover plates, toggle switches, electrical junction boxes, yokes, opposing tines, yoke spanning gaps, adapter spanning gaps, perimeter edges, adapter rings, external perimeter edges, internal perimeter edges, grooves, and raised portions are disclosed, such weatherproof toggle switch cover adapter assemblies, cover plates, toggle switches, electrical junction boxes, yokes, opposing tines, yoke spanning gaps, adapter spanning gaps, perimeter edges, adapter rings, external perimeter edges, internal perimeter edges, grooves, and raised portions, and implementing components, may comprise any shape, size, style, type, model, version, measurement, concentration, material, quantity, and/or the like as is known in the art for such weatherproof toggle switch cover adapter assemblies, consistent with the intended operation of a weatherproof toggle switch cover adapter assembly.

Figure 1:
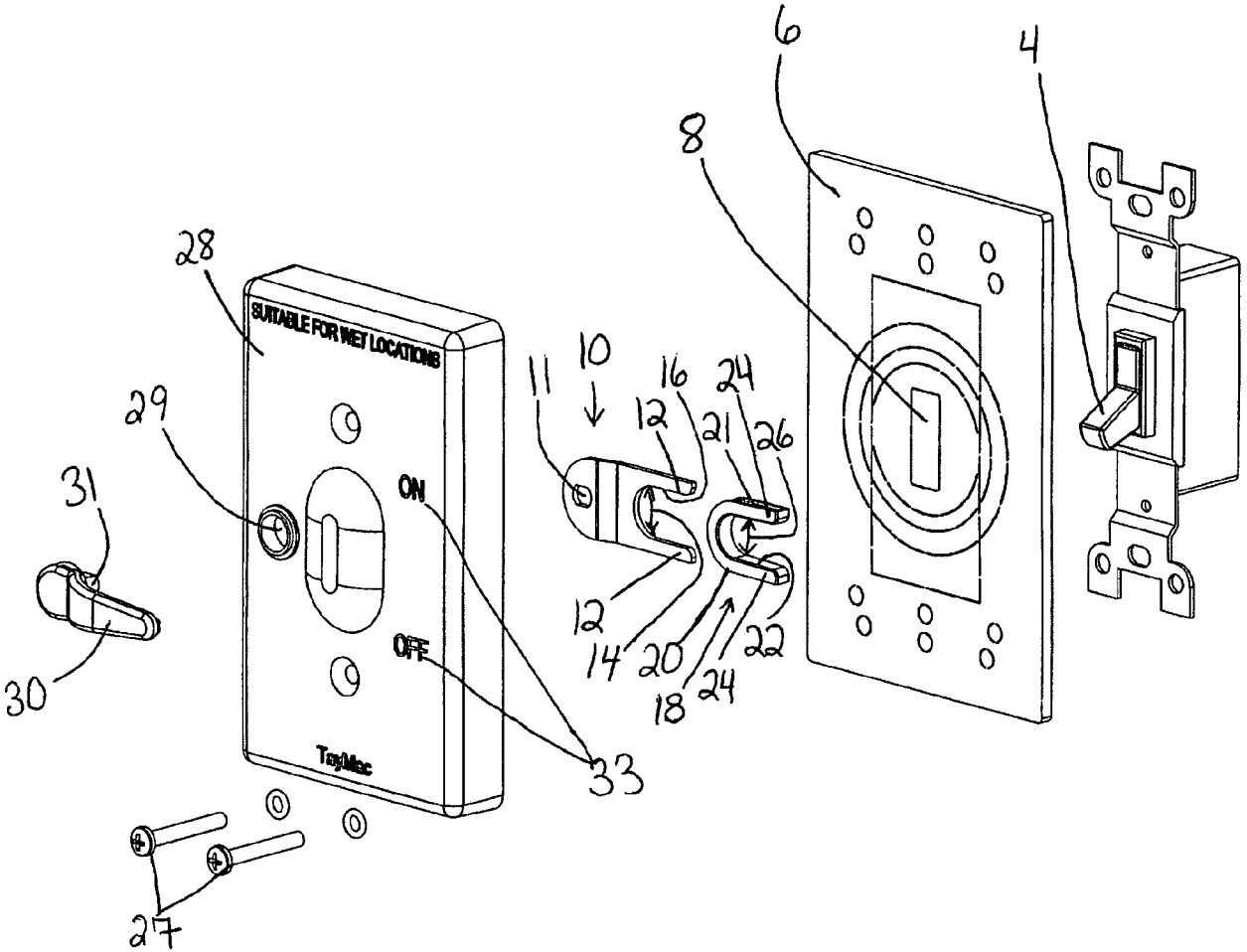
FIG. 1 is an exploded perspective view of a first particular implementation of a weatherproof toggle switch cover adapter assembly.
Figures 2A, 2B, 2C, 2D, 2E, 2F:
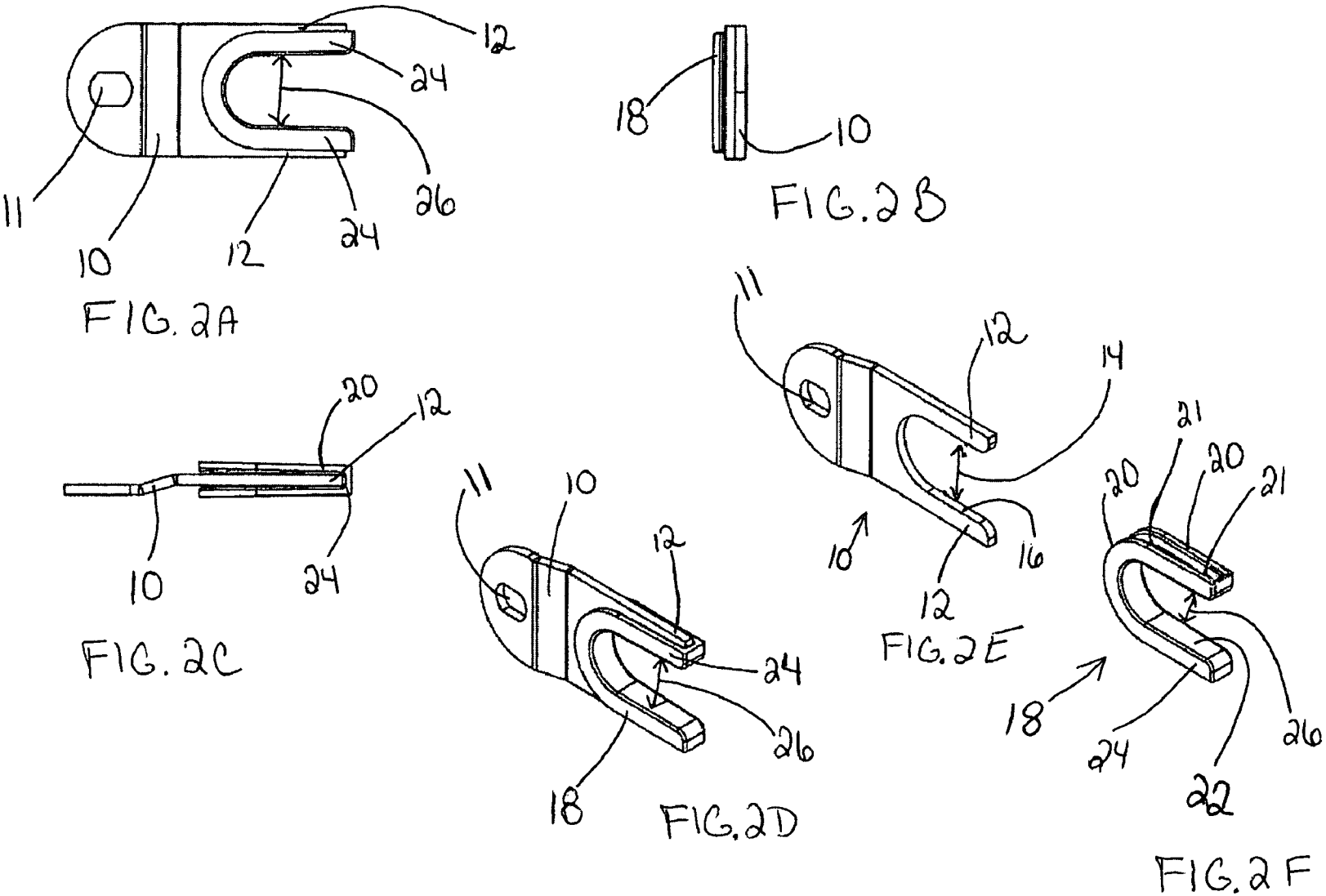
FIG. 2A illustrates a coupled front view of a first particular implementation of yoke and adapter ring.
FIG. 2B illustrates a coupled end view of a first particular implementation of yoke and adapter ring.
FIG. 2C illustrates a coupled top view of a first particular implementation of yoke and adapter ring.
FIG. 2D illustrates a coupled perspective view of a first particular implementation of yoke and adapter ring.
FIG. 2E illustrates a perspective view of a first particular implementation of a yoke.
FIG. 2F illustrates a perspective view of a first particular implementation of an adapter ring.

There are a variety of toggle switch cover adapter assembly implementations disclosed herein. FIGS. 1-2F illustrate a first particular implementation of a weatherproof toggle switch cover adapter assembly, and the associated description explains other implementations. Weatherproof toggle switch cover adapter assembly 2 (and other particular implementations of weatherproof toggle switch cover adapter assemblies described herein) is used to "adapt" or convert a toggle switch from a switch that is linearly positionable along a single vertical or horizontal axis to a switch that is rotationally pivotable along a plane. The first particular implementation of weatherproof toggle switch cover adapter assembly 2 comprises a toggle switch 4, a gasket 6 (comprising an opening 8), a yoke 10, an adapter ring 18, a cover plate 28 and an outer rotationally pivoting lever 30.

The toggle switch 4 shown in FIG. 1 is positionable between an "on" position and an "off" position by moving or "flipping" the toggle switch 4 along a straight vertical axis. Notwithstanding, depending upon the particular orientation selected during installation of the toggle switch 4, the switch may be moveable along either a vertical or horizontal axis. A user desiring to adapt a toggle switch 4 from a switch that is linearly positionable along a vertical or horizontal axis to a switch that is rotationally pivotable along a vertical plane may do so by coupling an outer rotationally pivoting lever 30 with the toggle switch 4, as described further below.

In some particular implementations, a user wishing to adapt (and weatherproof) a toggle switch 4 may first place a gasket 6 over the toggle switch 4 such that the toggle switch 4 protrudes through an opening 8 on the gasket 6. With the toggle switch 4 extending through the opening 8 of the gasket 6, a user may next place the lever 30 such that the lever post 31 passes through the cover plate 28 via post aperture 29. With the lever post 31 passed through post hole 29, a user may thereafter couple the lever 30 with the yoke 10 by inserting the lever post 31 in the lever post hole 11 of the yoke 10 (which may be held in position via an adhesive, rod, cotter pin, fastener, and/or the like). Next, a user may position the yoke 10 so that it spans or straddles the toggle switch 4. As illustrated, the yoke 10 comprises two opposing tines 12 that define a yoke spanning gap 14 (which comprises a perimeter edge 16). The yoke spanning gap 14 is sized (and may be shaped) such that the two opposing tines 12 straddle the toggle switch 4. The yoke spanning gap 14 (and all other spanning gaps described herein) may be generally u-shaped, v-shaped, c-shaped, and the edges defining a spanning gap (such as the yoke spanning gap 14) may be straight or curvilinear, depending upon the particular implementation. In any event, with the lever 30 coupled with the yoke 10, and with the yoke 10 straddling the toggle switch 4, a user may place the cover plate 28 (which may comprise one or more markings 33 describing "on" and "off" positions) over the toggle switch 4. The cover plate 28 may be coupled with an electrical junction box (not shown) that houses the toggle switch 4 via one or more box mounting screws 27. It will be understood that, with the lever 30 coupled to the yoke 10, and with the yoke 10 straddling the toggle switch 4, when the lever 30 is moved to its "on" position, the movement of the yoke 10 causes the toggle switch 4 to concomitantly move to its "on" position. Similarly, when the lever 30 is moved to its "off" position, the movement of the yoke 10 causes the toggle switch 4 to concomitantly move to its "off" position. It will be further understood that lever 30 rotationally pivots on lever post 31 such that the movement of the lever 30, as it is moved between on and off positions, describes an arc (as opposed the straight linear path of the toggle switch 4).

Significantly, conventional yokes for conventional rotationally pivoting lever-type switch covers are ordinarily made to fit only a single size of switch, typically a 20-Ampere toggle switch. Notwithstanding, other standard toggle switch sizes may be provided such as, by way of non-limiting example, 15-Ampere toggle switches, which are smaller than conventional 20-Ampere toggle switches. Consequently, in those cases where the toggle switch 4 comprises a 15-ampere switch (i.e. where it is a 15-Ampere toggle switch that is being adapted), the yoke 10 fits loosely over the 15-Ampere toggle switch, thus yielding an unsatisfactory "jiggle" or "play" in the lever 30. Accordingly, when the yoke 10 straddles a 15-Ampere toggle switch 4, the loose fit between the yoke 10 and the toggle switch 4 may cause the lever 30 to sag from its upright position, even when the toggle switch 4 is actually fully "on." Accordingly, when there is play between the yoke 10 and the toggle switch 4, users may become uncertain as to whether the lever 30 is broken and/or whether the toggle switch 4 is in its "on" or "off" position, since the position of the lever 30 no longer aligns with one of the one or more markings 33 on the over plate 28, and since the lever 30 points somewhere between "on" and "off" with respect to the markings 33.

Electricians, and other customers, do not always know what size the toggle switch 4 is, or will be, when they are purchasing weather-protective housings for the switches. All known switch cover manufacturers of this type of switch cover make their covers and/or yokes designed to fit a 20-Ampere toggle switch and, thus, have the previously described and received complaints regarding the problem of "play" and "jiggle" when the switch cover is used with smaller switch sizes.

An adapter ring 18 may be interposed between the yoke 10 and the toggle switch 4 in order to act as a "spacer" between the yoke 10 and the toggle switch 4. The adapter ring 18 may be particularly useful in eliminating the "jiggle" of lever 30, especially in those particular implementations involving a 15-Ampere toggle switch. The adapter ring 18 illustrated in FIG. 1 specifically comprises an external perimeter edge 20, an internal perimeter edge 22 and two opposing tines 24 that define an adapter spanning gap 26.

The adapter ring 18 may be coupled with the yoke 10 in a variety of ways. In some particular implementations, the adapter ring 18 may be coupled with the yoke 10 such that the external perimeter edge 20 of the adapter ring 18 is adjacent to the perimeter edge 16 of the yoke 10. In other particular implementations, the external perimeter edge 20 of the adapter ring 18 and the perimeter edge 16 of the yoke 10 are in contact with one another. In the first particular implementation, as shown especially in FIG. 2F, the external perimeter edge 20 of the adapter ring 18 comprises a channel 21. The channel 21 is sized (and may be shaped) to accept therein the two opposing tines 12 of the yoke two opposing tines of the yoke such that the channel 21 is in communication with the perimeter edge 16 of the yoke 10 via the sliding locking fit of two opposing tines 12 within the channel 21, as illustrated with respect to FIGS. 2A and 2D. In other particular implementations, the external perimeter edge 20 of the adapter ring may comprise a sleeve or other passageway to allow the entry of the two opposing tines 12 of the yoke. In still other particular implementations, the adapter ring 18 may be removably coupled with the yoke 10 via a pressure fit or a snap fit. In yet other particular implementations, the adapter ring 18 may be removably coupled with the yoke 10 via an adhesive. In still other particular implementations, the adapter ring 18 may be removably coupled with the yoke 10 via a fastener (not shown). In still other particular implementations, one of the external perimeter edge 20 (of the adapter ring 18) and the perimeter edge 16 (of the yoke 10) may comprise one of one or more raised portions (not shown) and one or more corresponding grooves (not shown) such that the mating of the one or more raised portions with the one or more grooves results in the removable coupling of the adapter ring 18 with the yoke 10.

A comparison of the yoke spanning gap 14 to the adapter spanning gap 26 (comparing FIG. 2E to FIG. 2F) shows that the adapter spanning gap 26 is smaller than the yoke spanning gap 14. Accordingly, the smaller adapter spanning gap 26 of the adapter ring 18 straddles the toggle switch 4 more snugly than the yoke spanning gap 14, particularly where the toggle switch 4 is a 15-Ampere toggle switch or other toggle switch 4 size. Thus, the comparatively snug fit between the adapter ring 18 and the toggle switch 4 may eliminate or otherwise reduce undesirable jiggle or play in the lever 30, which may be caused by the heretofore loose fit between the yoke 10 and the toggle switch 4. Accordingly, with an adapter ring 18 coupled with the yoke 10, the yoke spanning gap 14 of the yoke 10 is modified to more snugly fit a 15-ampere toggle switch, for example. Moreover, with the adapter ring 18 coupled with the yoke 10, the adapter spanning gap 26 of the adapter ring 18 straddles, and is immediately adjacent to, the toggle switch 4. It can be up to the installer when installing the weatherproof toggle switch cover adapter whether the adapter ring 18 is desirable or not and the adapter ring 18 can be installed when the cover adapter 2 is installed.

Turning now to FIGS. 3A-3F, these figures illustrates a second particular implementation of a yoke and adapter ring configuration. In particular, the yoke 32 comprises a lever post hole 34, a yoke body 35, two opposing tines 36 (comprising a bottom surface 37), a perimeter edge 38, and a yoke spanning gap 40. Significantly, the lever post hole 34 is analogous to the lever post hole 11 of the first particular implementation. Accordingly, it will be understood that that the relationship between the lever post hole 34 and lever 30 is analogous to the relationship and operation of the lever post hole 11 and the lever 30 of the first particular implementation. Thus, the second particular implementation illustrated in FIGS. 3A-3F may involve many of the same components as the first particular implementation, although with the specific substitution of the yoke 10 (of the first particular implementation) with the yoke 32 (of the second particular implementation), and the substitution of the adapter ring 18 (of the first particular implementation) with the adapter ring 42 (of the second particular implementation).

Figures 3A, 3B, 3C, 3D, 3E, 3F:
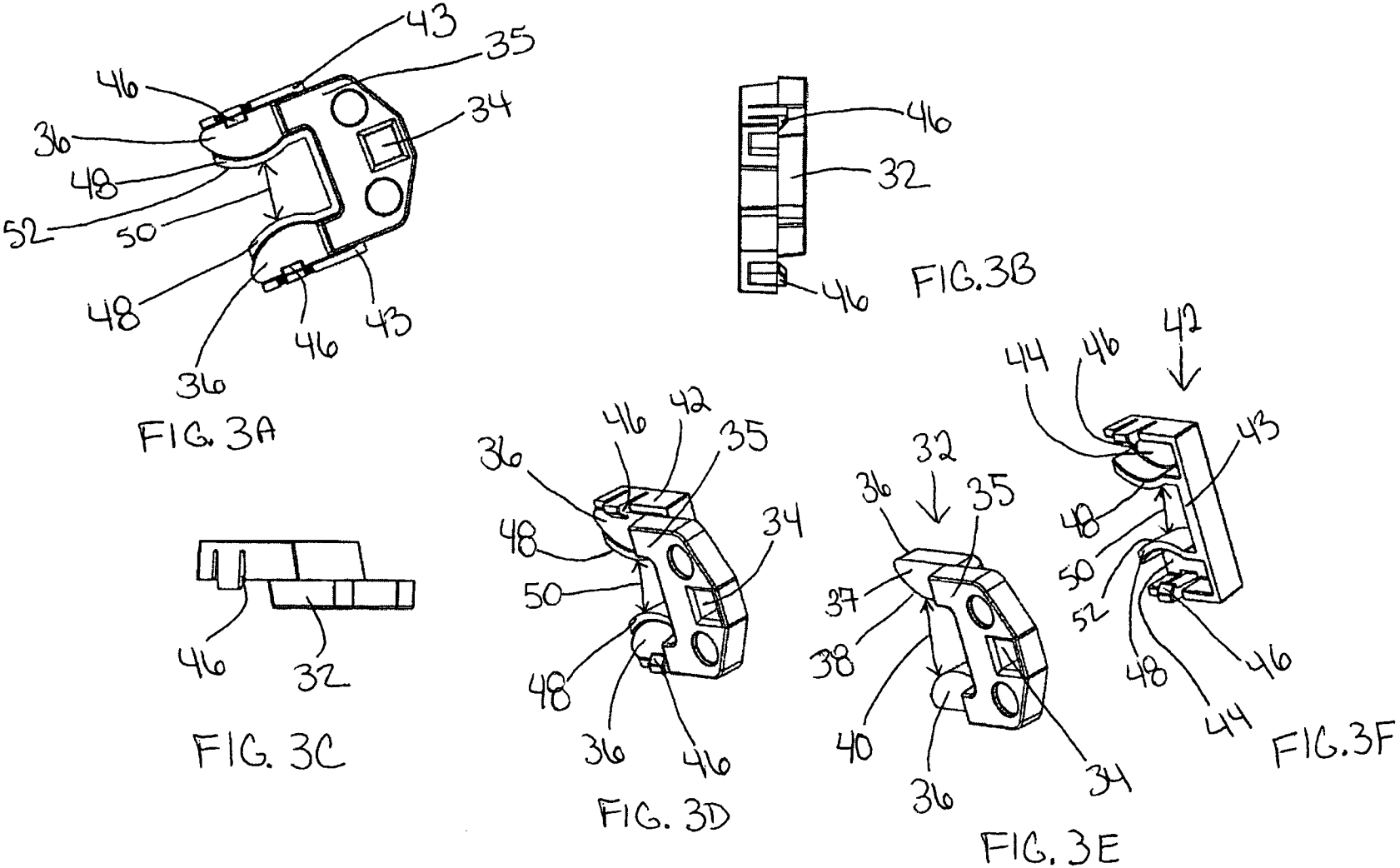
FIG. 3A illustrates a coupled front view of a second particular implementation of yoke and adapter ring.
FIG. 3B illustrates a coupled end view of a second particular implementation of yoke and adapter ring.
FIG. 3C illustrates a coupled side view of a second particular implementation of yoke and adapter ring.
FIG. 3D illustrates a coupled perspective view of a second particular implementation of yoke and adapter ring.
FIG. 3E illustrates a perspective view of a second particular implementation of a yoke.
FIG. 3F illustrates a perspective view of a second particular implementation of an adapter ring.

Referring specifically to FIG. 3E, the yoke body 35 and the two opposing tines 36 may be located along different spatial planes or may alternatively be located in the same plane. The two opposing tines 36 of the yoke 32 define a yoke spanning gap 40, which is sized (and may be shaped) to straddle a toggle switch 4 (FIG. 1). As shown in FIG. 3E, the yoke spanning gap 40 comprises a perimeter edge 38, which may be in contact with or adjacent to a toggle switch 4. In some particular implementations, the perimeter edge 38 may be curvilinear. In other particular implementations, perimeter edge 38 may comprise a straight edge. As in the first particular implementation, the yoke spanning gap 40 may not provide a desired tight fit with respect to certain types of toggle switches 4 (such as, by way of non-limiting example, a 15-Ampere toggle switch). Accordingly, an adapter ring 42 may be provided.

As in the first particular implementation, adapter ring 42 is interposed between the two opposing tines of the yoke 32, and acts as a spacer between the yoke 32 and the toggle switch 4. as shown in FIG. 3F, the adapter ring 42 of the second particular implementation comprises two opposing tine recesses 44, each recess defined by a locking tab 46 and a spacer body 48. The two opposing tine recesses 44 are each sized (and may be shaped) to accept therein one of the two opposing tines 36 of the yoke 32. A user may insert each of the two opposing tines 36 in its corresponding recess 44 such that each of the locking tabs 46 flex or bend in order to allow the insertion of the two opposing tines 36. Significantly, while any of the components defining the particular implementations of toggle switch cover adapter assemblies described herein may be constructed of a wide variety of materials, including plastics, metals, alloys, and combinations thereof, it is specifically contemplated that, with respect to the second particular implementation described herein, that the adapter ring 42 may constructed out of plastic, in order to allow the locking tabs 46 sufficient flexibility to allow the insertion of the two opposing tines 36 into the tine recesses 44.

As illustrated in FIGS. 3A and 3D, a user may continue to insert the two opposing tines 36 into their respective recesses 44 until the locking tabs 46 come into contact with a bottom surface 37 of the two opposing tines 36. With the locking tabs 46 in contact with the bottom surface 37 of the two opposing tines 36, the two opposing tines 36 are secured within their corresponding tine recesses 44 via the impingement of the locking tab 46 on the bottom surfaces of each the two opposing tines 36. In other particular implementations, a notch or groove may be disposed along an edge 39 of the two opposing tines such that the locking tabs 46 engage in the notch or groove.

Still referring to FIGS. 3A-3F, a space between the opposing spacer bodies 48 defines an adapter spanning gap 50 having an internal perimeter edge 52, the adapter spanning gap 50 sized (and may be shaped) to straddle a toggle switch 4. When installed, the internal perimeter edge 52 may be adjacent to or in contact with a toggle switch 4. It will be understood that adapter spanning gap 50 of the adapter ring 42 is smaller than the yoke spanning gap 40 of the yoke, thus providing a snugger fit with respect to smaller-sized toggle switches.

It will be understood by those of ordinary skill in the art that the concepts of coupling an adapter ring to a yoke to create weatherproof toggle switch cover adapters, as disclosed herein, is not limited to 15-Ampere or 20-Ampere toggle switches or to the specific implementations shown herein. For example, it is specifically contemplated that the components included in a particular implementation of a weatherproof toggle switch cover adapter may be formed of any of many different types of materials or combinations that can readily be formed into shaped objects and that are consistent with the intended operation of a weatherproof toggle switch cover adapter. For example, it is specifically contemplated that the components included in a particular implementation of a weatherproof toggle switch cover adapter may be formed of any of many different types of materials or combinations that can readily be formed into shaped objects and that are consistent with the intended operation of a weatherproof toggle switch cover adapter. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, the weatherproof toggle switch cover adapter assemblies, cover plates, toggle switches, electrical junction boxes, yokes, opposing tines, yoke spanning gaps, adapter spanning gaps, perimeter edges, adapter rings, external perimeter edges, internal perimeter edges, grooves, and raised portions are disclosed, such weatherproof toggle switch cover adapter assemblies, cover plates, toggle switches, electrical junction boxes, yokes, opposing tines, yoke spanning gaps, adapter spanning gaps, perimeter edges, adapter rings, external perimeter edges, internal perimeter edges, grooves, and raised portions, and any other components forming a particular implementation of a weatherproof toggle switch cover adapter assembly may be manufactured separately and then assembled together, or any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

It will be understood that particular implementations of weatherproof toggle switch cover adapter assemblies are not limited to the specific components disclosed herein, as virtually any components consistent with the intended operation of a method and/or system implementation for a weatherproof toggle switch cover adapter assembly may be utilized. Accordingly, for example, although particular weatherproof toggle switch cover adapter assemblies, cover plates, toggle switches, electrical junction boxes, yokes, opposing tines, yoke spanning gaps, adapter spanning gaps, perimeter edges, adapter rings, external perimeter edges, internal perimeter edges, grooves, and raised portions, and other components may be disclosed, such components may comprise any shape, size, style, type, model, version, class, grade, measurement, concentration, material, weight, quantity, and/or the like consistent with the intended operation of a method and/or system implementation for a weatherproof toggle switch cover adapter assembly may be used.

In places where the description above refers to particular implementations of a weatherproof toggle switch cover adapter assembly, it should be readily apparent that a number of modifications may be made without departing from the spirit thereof and that these implementations may be applied to other weatherproof toggle switch cover adapter assemblies. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A weatherproof toggle switch cover adapter assembly comprising:

a cover plate adapted for placement over a toggle switch and coupling with an electrical junction box;

a lever rotationally pivotably coupled with the cover plate and in mechanical communication with the toggle switch through a yoke such that when the lever is moved to an on position the toggle switch also moves to an on position, wherein the yoke comprises two opposing tines defining a yoke spanning gap having a perimeter edge, the yoke spanning gap sized to straddle the toggle switch; and an adapter ring comprising an external perimeter edge and an internal perimeter edge, wherein the external perimeter edge is in communication with the perimeter edge of the yoke, and wherein the internal perimeter edge is located inside two opposing tines and is disposed about an adapter spanning gap, the adapter spanning gap sized to straddle the toggle switch.

2. The assembly of claim 1, further comprising a weatherproof gasket adjacent to an edge of the cover plate.

3. The assembly of claim 1, wherein the external perimeter edge of the adapter ring comprises a channel sized to receive a portion of the perimeter edge of the yoke.

4. The assembly of claim 3, wherein the channel of the adapter ring is sized to slidably receive therein the two opposing tines of the yoke such that the channel is in communication with the perimeter edge of the yoke via the sliding fit of two opposing tines within the channel.

5. The assembly of claim 1, wherein the external perimeter edge of the adapter ring comprises one or more raised portions.

6. The assembly of claim 5, wherein the perimeter edge of the yoke comprises a channel sized to slidably accept therein the one or more raised portions of the adapter ring such that the external perimeter edge of the adapter ring is in communication with the perimeter edge of the yoke via the sliding fit of the one or more raised portions within the channel.

7. A weatherproof toggle switch cover adapter assembly comprising:

a cover plate adapted for placement over a toggle switch and coupling with an electrical junction box;

a lever rotationally pivotably coupled with the cover plate and in mechanical communication with the toggle switch through a yoke such that when the lever is moved to an on position the toggle switch also moves to an on position, wherein the yoke comprises two opposing tines defining a yoke spanning gap having a perimeter edge, the yoke spanning gap sized to straddle the toggle switch; and an adapter ring comprising two opposing tine recesses each sized and accept therein one of the two opposing tines, each tine recess defined by a locking tab and spacer body and, wherein the two opposing tines of the yoke are secured within its corresponding tine recess via impingement of the respective locking tab on its respective opposing tine, and wherein a space between the spacer bodies defines an adapter spanning gap having an internal perimeter edge, the adapter spanning gap sized to straddle the toggle switch.

8. The assembly of claim 7, further comprising a weatherproof gasket adjacent to an edge of the cover plate.

9. The assembly of claim 8, wherein the internal perimeter edge of the adapter ring is curvilinear.

10. The assembly of claim 9, wherein the perimeter edge of the yoke is curvilinear.

11. A method of configuring a weatherproof toggle switch cover adapter assembly comprising:

placing an adapter ring between two opposing tines of a yoke;

coupling the adapter ring to a perimeter edge of the two opposing tines of the yoke; and straddling the toggle switch with a spanning gap of the adapter ring.

12. The method of claim 11, wherein coupling the adapter ring to the yoke comprises placing an external perimeter edge of the adapter ring adjacent to the perimeter edge of the two opposing tines of the yoke.

13. The method of claim 11, wherein coupling the adapter ring to the yoke comprises placing an external perimeter edge of the adapter ring in direct contact with the perimeter edge of the two opposing tines of the yoke.

14. The method of claim 11, wherein coupling the adapter ring to the yoke comprises pressure fitting the adapter ring between the two opposing tines of the yoke.

15. The method of claim 11, wherein coupling the adapter ring with the yoke comprises selectively mating the two opposing tines of the yoke with the channel of the adapter ring.

16. The method of claim 11, wherein coupling the adapter ring with the yoke comprises impinging the two opposing tines of the yoke in two opposing tine recesses of the adapter ring via impingement of a locking tab of the adapter ring on each of the two opposing tines.

* * * * *